United States Patent [19]
Goodman
[11] 4,353,768
[45] Oct. 12, 1982

[54] METHOD FOR CONSTRUCTING A LIGHTWEIGHT RESISTIVE SCREEN FOR UNDERWATER SOUND ABSORPTION

[75] Inventor: Jerome Goodman, Baltimore, Md.

[73] Assignee: The United States of America as represented by the Secretary of the Navy, Washington, D.C.

[21] Appl. No.: 306,840

[22] Filed: Sep. 29, 1981

[51] Int. Cl.[3] ..... B32B 3/12; E04B 1/84

[52] U.S. Cl. ..... 156/253; 428/117; 181/286; 181/288; 181/292; 181/296; 156/293

[58] Field of Search ..... 156/253, 293; 181/286, 181/288, 292, 294, 296, 175; 367/1, 162; 428/117, 137; 29/163.5 F; 264/22, 267, 269, 273, 154, 259

[56] References Cited

U.S. PATENT DOCUMENTS

| | | | |
|---|---|---|---|
| 3,095,943 | 7/1963 | Kemp | 181/292 |
| 3,435,190 | 3/1969 | Schirmer | 264/154 |
| 3,594,261 | 7/1971 | Broerman | 264/154 |
| 3,653,901 | 4/1972 | Etter | 430/23 |
| 3,770,434 | 11/1973 | Law | 430/23 |
| 4,241,806 | 12/1980 | Metzger | 428/117 |

FOREIGN PATENT DOCUMENTS

| | | | |
|---|---|---|---|
| 54-11690 | 5/1979 | Japan | 181/294 |

OTHER PUBLICATIONS

New Opportunities for Metalworking? *Steel,* Aug. 10, 1959, pp. 126–128.

Fluid Jet Lutter for Plastics, SPE Journal, Jul. 1972, p. 5.

Lightweight Cellular Metal, Lipson et al., *Modern Castings,* vol. 39, #2, Feb. 1961, pp. 57–71.

*Primary Examiner*—Edward C. Kimlin
*Assistant Examiner*—F. K. Wine
*Attorney, Agent, or Firm*—R. F. Beers; L. A. Marsh

[57] ABSTRACT

A method for preparing a resistive screen for underwater sound absorption consisting of a metallic honeycomb structure, adding a thermosetting plastic material to the cells within said structure, heating said structure under pressure and forming small apertures within said thermosetting plastic material.

5 Claims, No Drawings

METHOD FOR CONSTRUCTING A LIGHTWEIGHT RESISTIVE SCREEN FOR UNDERWATER SOUND ABSORPTION

BACKGROUND OF THE INVENTION

1. Field of the Invention

This invention is directed to a lightweight resistive screen for underwater sound absorption and more particularly to a novel method for constructing the same. The screen may also be used as a fine liquid filter.

2. Description of the Prior Art

Sound absorbing bodies are known for use where sound absorption is necessary. For example, U.S. Pat. No. 4,113,053 illustrates a sound absorbing body having a number or sound absorbing cavities that are inclined at an angle which is smaller than 80° with respect to a transverse horizontal sectional plane of the body wherein said sound absorbing cavities are opened at the sound incident surface. And, U.S. Pat. No. 4,164,727 illustrates an underwater acoustic absorber and reflector having an impervious rigid metal bonded to a rubber tile and when installed on baffle plates of an underwater vehicle the absorber maintains its efficiency under hydraulic pressure. Further, U.S. Pat. No. 4,150,850 and its divisional U.S. Pat. No. 4,077,821 illustrate use of foam type laminates, particularly in automotive headliners, where sound attenuation is very important. And, U.S. Pat. No. 4,247,586 illustrates a similar use as the two U.S. patents enunciated just above but goes one step further by providing various types of depressions which can be filled with sound absorbing materials.

SUMMARY OF THE INVENTION

The present invention provides a method for preparing a resistive screen for underwater sound absorption utilizing a stiffening type structure, adding a plastic material to the cells within said structure, heating said structure under pressure and forming small apertures within said plastic material. The present invention also provides the ultimate structure's use as a very fine liquid filter.

STATEMENT OF THE OBJECTS OF THE INVENTION

An object of the present invention is to provide a method for preparing a lightweight resistive screen for underwater sound absorption.

Another object of the present invention is to provide a method for preparing a lightweight resistive screen for underwater sound absorption which provides substantial weight reduction, size reduction, and cost reduction.

Still another object of the present invention is to provide a method for preparing a lightweight resistive screen utilizable as a very fine liquid filter.

Other objects and many of the attendant advantages of this invention will be readily appreciated as the same becomes better understood by reference to the following detailed description.

DESCRIPTION OF THE PREFERRED EMBODIMENTS

A honeycomb type structure of steel or aluminum having a thickness of from about one fourth inch to one inch and a core size of from one half inch to one inch is filled with a plastic molding powder. Such molding plastic powder is a thermosetting plastic and preferably an epoxy resin, a polyester resin or a polyimide resin. The honeycomb type structure containing the plastic powder is then inserted into a standard type molding press utilizing appropriate heat and pressure for the type thermosetting plastic material used to form a rigid structure. The stiffness of the honeycomb type structure is enhanced by the intimate bonding of the plastic matrix to the walls of the metal honeycomb structure and the structure is controlled to yield a thickness of about one quarter inch to one inch.

Table 1 illustrates screen and test sample parameter values for a complex and expensive reinforced metal etched steel screen which this invention replaces. Acoustic dissipation is attained when the screen has sufficient stiffness to make it rigid and unyielding when it is irradiated by acoustic energy.

TABLE 1

| Screen and Test Sample Parameter Values | |
|---|---|
| 1. Resistive Screen | |
| Stainless Steel | |
| E | $1.66 \times 10^{-11}$ N/m$^2$ effective Young's modulus accounting for the pores |
| d | .015" diameter circular pores |
| t | 0.14" thickness |
| $h_s$ | 21% overall porosity (no blockage due to honeycomb) |
| $\nu$ | .287 Poisson's ratio |
| 2. Outer Face Sheets (large perforations) | |
| Stainless Steel | |
| $E_2$ | $7.8 \times 10^{10}$ N/m$^2$ effective Young's modulus accounting for perforations |
| | .156" diameter holes |
| | 63% overall porosity |
| $t_2$ | .032" thickness |
| 3. Reinforcing Honeycomb Layers | |
| Aluminum | |
| | 3/16" cell diameter |
| | .002" wall thickness - 5.7 lb/ft$^3$ density |
| h | .5" total thickness of honeycomb (2 × ¼") |
| 4. Annular Sleeve | |
| Stainless Steel | |
| $t_3$ | .040" wall thickness |
| $a_2$ | 1" radius of test sample |
| l | 2.6" distance from fine screen to back plate |

The acoustic pulse tube test sample configuration and the reinforced composite honeycomb screen design are illustrated with parameter values given in Table 1. Several stiffnesses are important and act in parallel in prohibiting the motion of the screen structure. $K_1$ describes the motion of the screen spanning an individual honeycomb cell. $K_2$ describes the flexural deformation of the composite screen relative to the support sleeve, and $K_3$ describes the compression of the support sleeve relative to the back plate. The stiffnesses are defined in terms of a uniform pressure and average deflection over the surface of the screen. The effective stiffness, $K_e$, is given by the parallel combination:

$$\frac{1}{K_e} = \frac{1}{K_1} + \frac{1}{K_2} + \frac{1}{K_3} \quad (1)$$

For a uniform circular plate with clamped edges under the action of a uniform load, the maximum deflection at the center of the plate is:

$$y_c = \frac{\Delta p a^4}{64D} \quad (2)$$

-continued $$D = \frac{Et^3}{12(1 - \nu^2)}$$

where $\Delta p$ is the uniform load (force/area); a is the radius; t is the thickness; and E and $\nu$ are Young's modulus and Poisson's ratio all for the plate. The average deflection $Y_{avg}$ equals $\frac{2}{3}$ the maximum deflection so that the stiffness of the plate becomes:

$$K = \frac{96D}{a^4} \tag{3}$$

Based on the parameter values in Table 1, the stiffness of the screen spanning a honeycomb cell computed based on Eqs. 2 and 3 is:

$$K_1 = 2.02 \times 10^{12} \frac{N}{m^3}$$

The stiffness of the composite screen relative to the support ring is also determined from Eq. 3 with the flexural rigidity D given by the following formula:

$$D = \frac{E_2 t_2 (h + t_2)2}{2\,(1 - \nu^2)} \tag{4}$$

$E_2$ is the Young's modulus for the face sheets and accounts for the presence of the perforations. In computing $K_2$, a in Eq. 3 is the radius of the test sample:

$$K_2 = 1.45 \times 10^{12} N/m^3$$

The stiffness governing the compression of the support sleeve relative to the back plate is given by the following:

$$K_3 = \frac{E_1 2 t_3}{l a_2} \tag{5}$$

$$= 2.54 \times 10^{11} N/m^3$$

The smallest stiffness involves the compression of the support sleeve. It could be made stiffer by decreasing the distance between the screen and back plate or by increasing the wall thickness. The distance is specified by the desired location of the $\frac{1}{4}$ wavelength resonance frequency of the sample while the wall thickness is held to a minimum so as not to excessively reduce the active cross-sectional area of the sample.

The effective stiffness from Eq. 1 is:

$$K_e = 1.95 \times 10^{11} N/m^3$$

The equation governing the acoustic behavior of the screen is:

$$\frac{\Delta P}{V_f} = \frac{Ro}{1 + \frac{R_o}{Z_s}} \tag{6}$$

where $Z_s$ is the impedance governing the motion of the screen structure, $\Delta P$ is the acoustic pressure difference across the screen, and $V_f$ is the acoustic velocity at the surface of the screen. $R_o$ is the design acoustic resistance with no motion of the screen structure.

The effective acoustic resistance provided by the screen is the real part of the right-hand side of Eq. 6:

$$R_{eff} = R_o \left\{ \frac{1}{1 + \frac{R_o^2}{|Z_s|^2}} \right\} \tag{7}$$

Accounting only for the stiffness of the screen support system below resonance:

$$Z_s = \frac{K_e}{-i\omega} \tag{8}$$

The effect of insufficient rigidity is readily seen from Eqs. 7 and 8. For an insufficient stiffness at the design frequency such that $$\frac{K_e}{\omega} < R_o$$

then $$R_{eff} << R_o.$$

Resonances in the screen and support structure will also produce the same effect. At resonance the impedance, $Z_s$, governing the motion of the screen is small; the screen is free to move with the fluid thereby reducing the relative motion and viscous dissipation.

Based on a design acoustic resistance near $\rho c$ for water, the above value for $K_e$ and a $\frac{1}{4}$ wavelength resonance frequency of 3.5 kHz, the effective flow resistance computed according to Eq. 4 is:

$$\frac{R_{eff}}{R_o} = .97$$

The reduction in effective acoustic resistance as a result of motion of the screen structure is insignificant.

The honeycomb reinforced structure of this invention is then subjected to a punching process to form a controlled array of microscopic holes that provide flow resistance. The punching process utilized is by laser drilling, high velocity liquid droplets, neutron irradiation, or electrical spark discharge, other methods are available to make said microscopic holes and these are representative examples.

The resistance needed or desired is calculated by the Hagen-Poiseuille law wherein:

$$R = \frac{8\,\mu t}{\sigma a^2}$$

and

R = flow resistance t = thickness of the plate structure $\mu$ = viscosity of the fluid permeating the screen $\sigma$ = porosity, or % of open area on the plate structure represented by the area of the pores a = radius of pore For a perfect acoustic impedance match with water—the flow resistance is 150,000 cgs rayls.

The various parameters of necessity to yield the desired impedance is illustrated according in this invention.

10 db=90% absorption of acoustic energy upon the screen 20 db=99% absorption of acoustic energy upon the screen It was observed that using long chain polymer fluids of high viscosity to achieve acoustic resistances comparable to pc for water introduces effects related to the viscoelastic behavior of these fluids. As a result of thermodynamic relaxation processes the viscosity of the fluids decreases at high frequencies. It was also observed that the dependence of viscosity of molecular weight or degree of polymerization of the fluid which is pronounced for steady shear flow is not as significant for oscillatory shear flow at high frequencies.

Previous acoustic tests of resistive screen samples involved uncertainties due to insufficient rigidity and resonant motions of the screen structure. Such motion adversely affects the dissipation of acoustic energy by reducing the relative motion of the fluid and the screen structure. Later tests utilized rigid test samples with resonances that occured above the frequency range of interest.

Viscous dissipation is provided by the shearing motion of a viscous fluid in the pore relative to the structure of the screen. The higher viscous polymer fluids such as the silicone oils exhibit linear viscoelastic behavior which significantly influences the design of resistive screens. With the impedance tube evaluations of the metal etched foil screens designed as above and reviewed, acoustic flow resistances equal to ~0.5 pc for water were achieved. Any discrepancies between estimated flow resistances and measured levels are related to the viscoelastic behavior of the fluid.

The flow resistance provided by a perforated sheet depends upon the nature of the perforations, whether circular holes or slots, their dimensions, the overall porosity, the thickness of the sheet and the viscosity of the fluid within the perforations. The flow resistance is given by the expression:

$$Ro = Ko \frac{\mu t}{h_s d^2} \tag{9}$$

where $K_o$—geometric factor $K_o = 32$ for circular holes $K_o = 12$ for rectangular slots $\mu$—absolute viscosity of the fluid t—thickness of the screen $h_s$—overall porosity of the screen d—pore dimensions slot—narrow dimension circular pore—diameter Based on the screen parameters in Table 1 an absolute viscosity of ~41 poise is required for an acoustic resistance equal to pc for water. The blockage of pores by the honeycomb and adhesive will reduce the porosity in Eq. 9 thereby reducing the required fluid viscosity.

The reinforced plastic screen of this invention eliminates the expensive complexities of the etched metal foil screen utilized by the prior art by obviating the need for the outer perforated face sheets of Table 1, by reducing the amount of silicone fluid required as there is no need to fill the empty cells of the honeycomb stiffener and by requiring a low viscosity silicone oil the acoustic degradation caused by the viscoelastic behavior of the silicone fluid at high frequencies is minimized.

Obviously, many modifications and variations of the present invention are possible in light of the above teachings.

What is claimed is:

1. A method for preparing a resistive screen for underwater sound absorption consisting of a stiffening cell type structure, the method comprising adding a thermosetting type plastic material to the cells within said structure, wherein said structure's thickness is from about one-fourth inch to about one-half inch, heating said structure under pressure until said thermoplastic is rigid and forming small apertures within said plastic material by a method selected from the group consisting of laser irradiation, high velocity liquid droplets, neutron irradiation, and electrical spark discharge.

2. A method for preparing a resistive screen for underwater sound absorption as in claim 1 wherein said stiffening type structure is a metallic structure.

3. A method for preparing a resistive screen for underwater sound absorption as in claim 2 wherein said metallic structure is selected from the group consisting of steel, aluminum, and a combination of steel and aluminum.

4. A method for preparing a resistive screen for underwater sound absorption as in claim 1 wherein said thermosetting plastic material is selected from the group consisting of epoxy resins, polyester resins, and polyimide resins.

5. A method for preparing a resistive screen for underwater sound absorption as in claim 1 wherein said small apertures are microscopic in size.

* * * * *